US007004886B2

(12) United States Patent
Chen

(10) Patent No.: US 7,004,886 B2
(45) Date of Patent: Feb. 28, 2006

(54) AIR CUSHION FOR EXERCISE

(76) Inventor: Wen-Hsing Chen, No. 4, Chang An Lane, Wah Tsuoh Village, Shi Jou Hsiang, Changhua Hsien (TW)

( * ) Notice: Subject to any disclaimer, the term of this patent is extended or adjusted under 35 U.S.C. 154(b) by 0 days.

(21) Appl. No.: 10/428,813

(22) Filed: May 2, 2003

(65) Prior Publication Data

US 2004/0220029 A1 Nov. 4, 2004

(51) Int. Cl.
*A63K 3/00* (2006.01)

(52) U.S. Cl. ..... 482/14; 482/34; 482/146

(58) Field of Classification Search ..... 482/907, 482/34, 146, 142, 91, 147, 79–80; 446/220
See application file for complete search history.

(56) References Cited

U.S. PATENT DOCUMENTS 4,107,830 A * 8/1978 Thomson ..... 492/14
4,268,030 A * 5/1981 Richards ..... 482/85
4,770,412 A * 9/1988 Wolfe ..... 482/85
4,826,159 A * 5/1989 Hersey ..... 482/146
5,643,182 A * 7/1997 Engel ..... 601/119
5,961,426 A * 10/1999 Spector ..... 482/83
6,017,297 A * 1/2000 Collins ..... 482/146
6,390,958 B1 * 5/2002 Chu ..... 482/90
6,554,753 B1 * 4/2003 Weck et al. ..... 482/147
2003/0148860 A1 * 8/2003 Wren ..... 482/83
2004/0023571 A1 * 2/2004 Warriner ..... 441/37

* cited by examiner

*Primary Examiner*—Gregory L. Huson
*Assistant Examiner*—L. Amerson
(74) *Attorney, Agent, or Firm*—Dellett & Walters

(57) ABSTRACT

An air cushion for exercise in accordance with the present invention has a bladder (10) and a ballast stay (15) accommodated inside the bladder (10). The bladder (10) has a flat bottom (11) and a bulge top (12). The ballast stay (15) is thermally welded to the bottom (11) to stiffen the bottom (11) to make the air cushion stably placed on the ground. Combining the bladder (10) and ballast stay (15) in one piece makes the configuration of the air cushion simple and also simplifies the manufacturing process to reduce product cost of the air cushion.

8 Claims, 7 Drawing Sheets

AIR CUSHION FOR EXERCISE

BACKGROUND OF THE INVENTION

1. Field of the Invention

The present invention relates to an air cushion, and more particularly to a one-pieced air cushion that is semi-spherical and easily produced.

2. Description of Related Art

Many devices are known for facilitating exercises done for therapy, conditioning or physical training. Other than variable resistance training equipment, these devices have not usually offered much adjustability to allow for exercises at different degrees of difficulty. Also, many of these devices have been dedicated to very specific exercises and therefore do not justify a significant investment of space and financial resources for such a narrow purpose.

Some exercise devices require a person to maintain balance and equilibrium. A large inflatable ball, know as a Swiss ball, has been used for this purpose. While the ball is useful for certain stability training exercises, standing upon the ball or swaying atop the ball require a high degree of skill and is inappropriate for most.

Therefore, a conventional air cushion is shaped partially spherical (most are semi-spherical) and is invented to substitute the inflatable ball to provide a mild and easy training way to users. With reference to FIG. 7, the conventional inflatable device is composed of a base (50), a bladder (60) and a securing frame (70).

The base (50) is a round plate and has a top face (52), a bottom face (not numbered), and a clamping edge (54) around the round plate. The bladder (60) is semi-spherical shaped and has an inflatable top (62), a flat bottom side (not shown), a clamping rim (66) formed at joint of the inflatable top (62) and the flat bottom side. The bladder (60) is mounted on the top face (52) of the base (50) to which the flat bottom side (64) of the bladder (60) is attached, wherein the clamping edge (54) of the base (50) overlaps with the clamping rim (66) of the bladder (60).

The securing frame (70) is composed of two semi-annular strips (71) and each strip (71) has an annular groove (72), an inner side (not numbered), an outer side and two distal ends (not numbered). The annular groove (72) is U-shaped and defined in the inner side of the strip (71) to receive the clamping rim (66) of the bladder (60) and the clamping edge (54) of the base (50) simultaneously to combine the bladder (60) and the base (50) together. Each distal end has an ear (74) formed on the outer side and a threaded hole (742) defined in one of the distal ends of each strip (71), and a securing hole (744) defined in the other distal end of the strip. (71). When the two semi-annular strips (71) are looped around the base (50) and the bladder (60), each distal end of one strip (71) abuts the corresponding distal end of the other strip (71) to make the threaded hole (742) align with the securing hole (744). Hereafter, a bolt (76) penetrates the securing hole (744) and engages with the threaded hole (742) to secure the base (50) and the bladder (60).

According to the above description, the conventional air cushion is composed of multiple elements such as the base (50), the bladder (60) and the securing frame (70). A mold has to be prepared for each element and those elements are produced individually by different manufacturing procedures. Therefore, the conventional air cushion for exercise has high manufacturing cost and needs too many processes for combining the elements to make the air cushion.

The present invention has arisen to mitigate or obviate the disadvantages of the conventional air cushion for exercise.

SUMMARY OF THE INVENTION

The main objective of the present invention is to provide an air cushion for exercise that is one-pieced to save manufacturing cost.

Further benefits and advantages of the present invention will become apparent after a careful reading of the detailed description with appropriate reference to the accompanying drawings.

DETAILED DESCRIPTION OF THE PREFERRED EMBODIMENT

Figure 1:
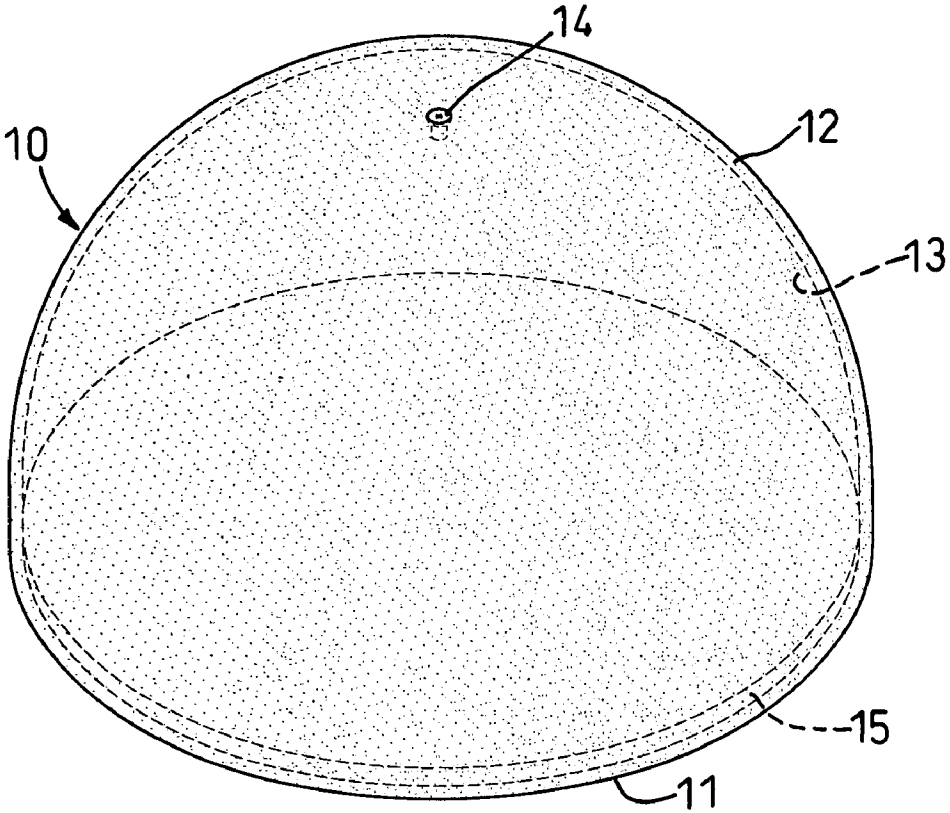
FIG. 1 is a perspective view of an air cushion for exercise in accordance with the present invention.
Figure 2:
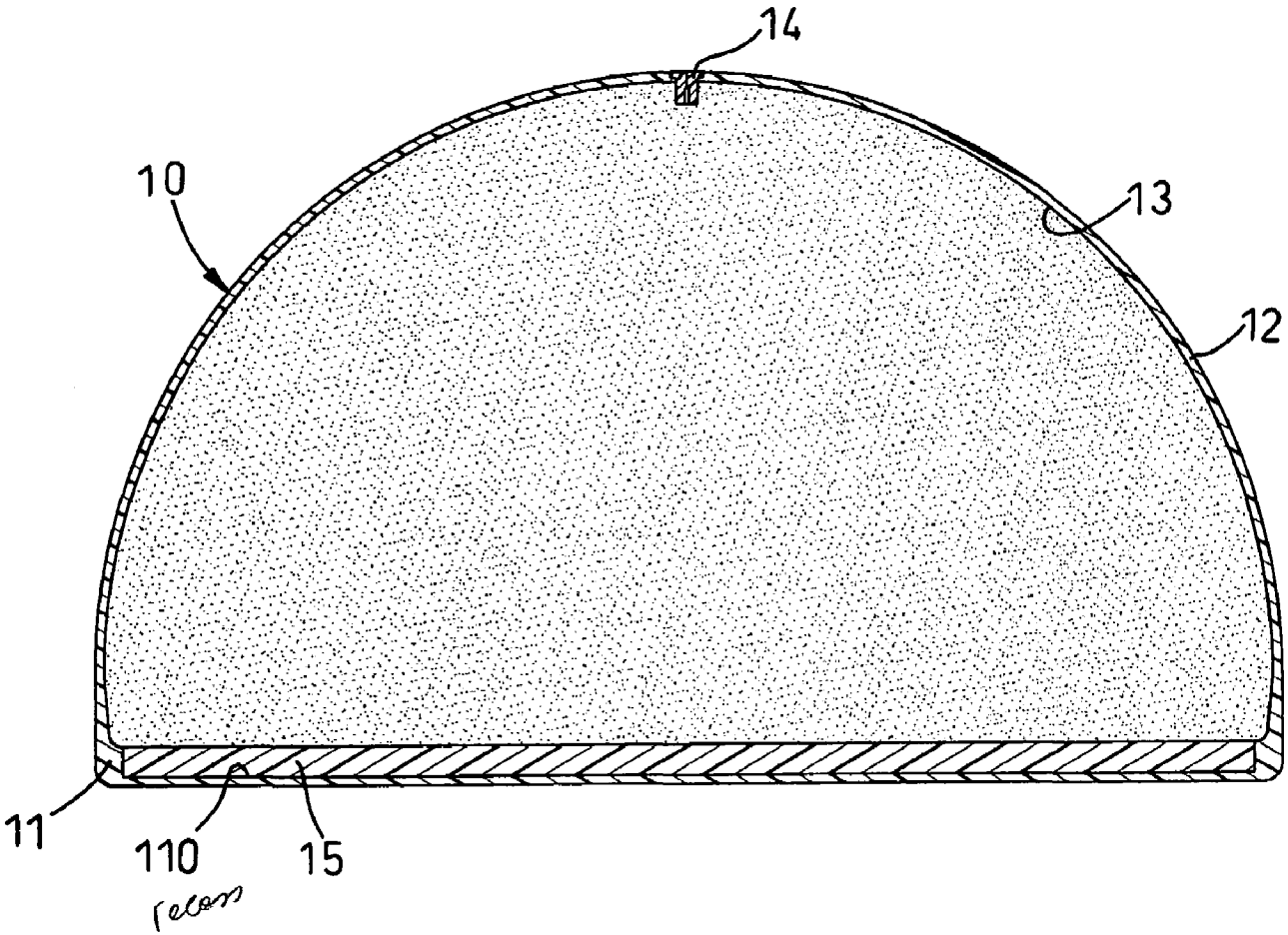
FIG. 2 is a cross-sectional side plane view of the air cushion for exercise shown in FIG. 1.

With reference to FIGS. 1 and 2, an air cushion for exercise in accordance with the present invention comprises a bladder (10) made of resilient plastic material and a ballast stay (15) made of hard plastic material formed inside the bladder (10) in one piece.

The bladder (10) is semi-spherical shaped and has a bottom (11), a bulge top (12) with an apex, an outer periphery (not numbered), an interior (13) and an air inlet (14). The bottom (11) of the bladder (10) is shaped flat and has a recess (110) defined in the bottom (11) inside the bladder (10) to accommodate the ballast stay (15). The air inlet (14) is attached to the apex of the bulge top (12) and is selectively opened to allow air to be pumped into the interior (13) of the bladder (10) and is selectively closed to hermetically seal the bladder (10). Moreover, the quantity of the air pumped into the bladder (10) adjusts the degree of softness of the air cushion.

The ballast stay (15) embedded at the bottom (11) inside the bladder (10) is a plate, and optionally is a round plate, made of hard plastic to stiffen the bottom (11) of the bladder and keep the bottom (11) flat. Therefore, the air cushion is stable when the bottom abuts the ground. Additionally, the ballast stay (15) can be made of hard plastic material that is particularly heavy lower the center of gravity of the air cushion and thus provide extra stability to the air cushion. The ballast stay (15) is formed first and then surrounded by the bladder (10) while the bladder (10) is being formed. Since the ballast stay (15) and the bladder (10) are both plastic, the ballast stay (15) is easily thermal welded with the bladder (10) at surfaces when the operational temperature is controlled properly. Therefore, the air cushion is easily completed by forming the bladder (10) around the ballast stay (15) and by welding the ballast stay to the bottom (11) at the same time. Whereby, no extra combining processes are needed as described in the conventional air cushion and the manufacturing cost of the air cushion in the present invention is reduced compared to that conventional art. Such a plastic forming technique is well known to a person skilled in this field, thus no redundant description of manufacture is mentioned here.

Figure 3:
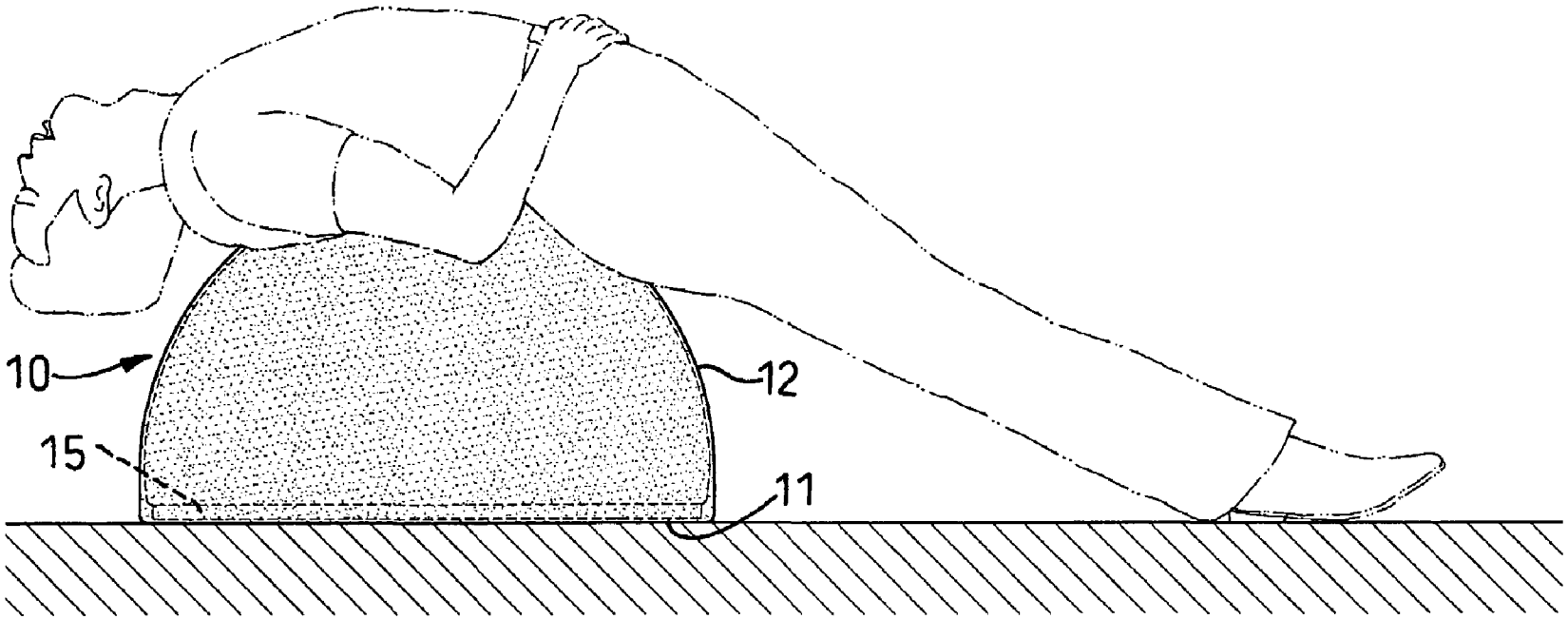
FIG. 3 is an operational side plane view of the air cushion for exercise shown in FIG. 1, wherein a user lies on the air cushion to exercise back muscles.

With reference to FIG. 3, when the air cushion is used, the bottom (11) of the bladder (10) contacts with the ground. A user can lie on the bulge top (12) to curve and extend his spine along the outer periphery of the bladder (10). Moreover, the user also can sit on the bulge top to swing his body or perform sit-up exercises.

Figure 4:
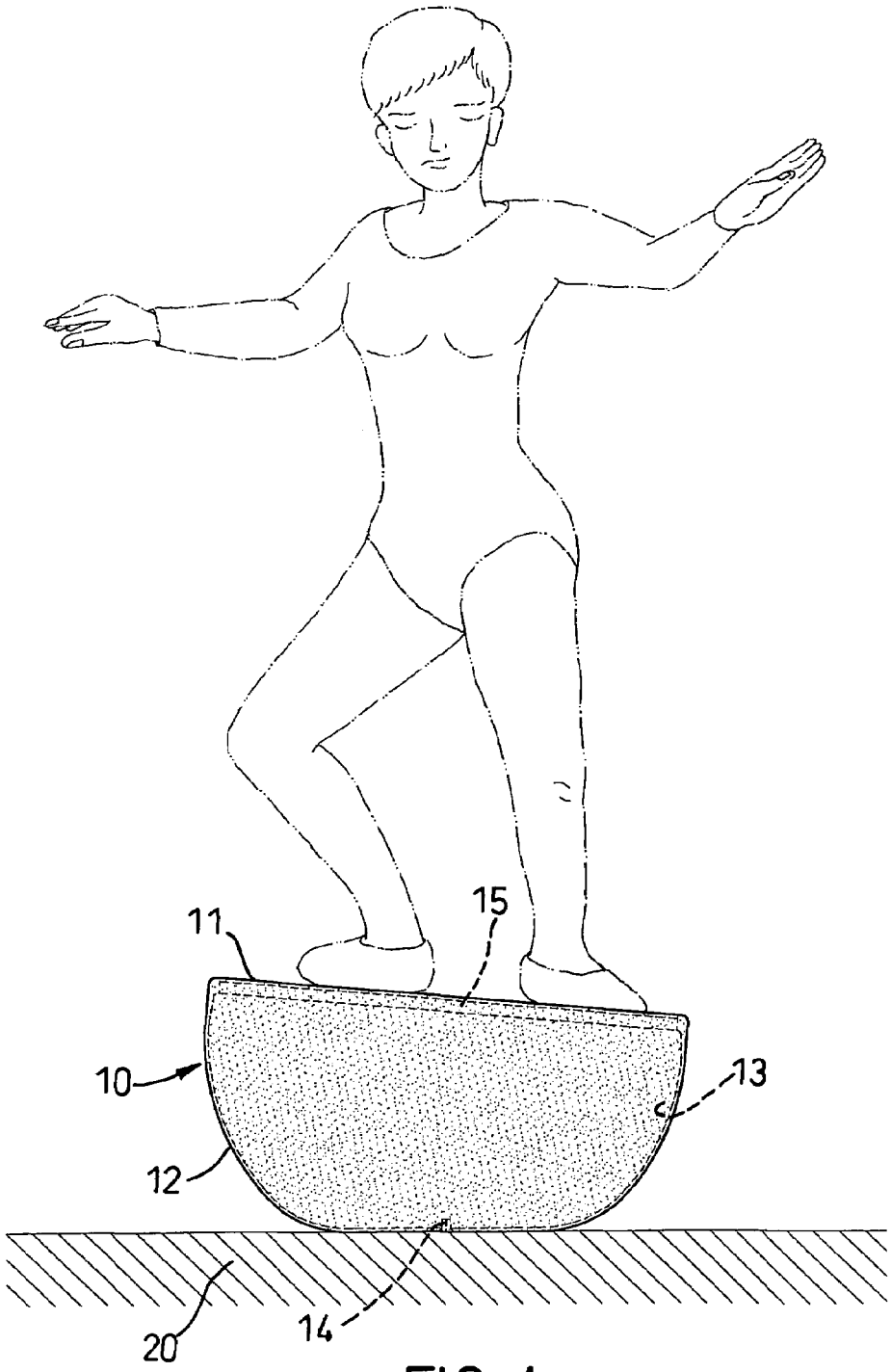
FIG. 4 is an operational side plane view of the air cushion, wherein the air cushion is placed upside down for a user to develop balancing skills.
Figure 5:
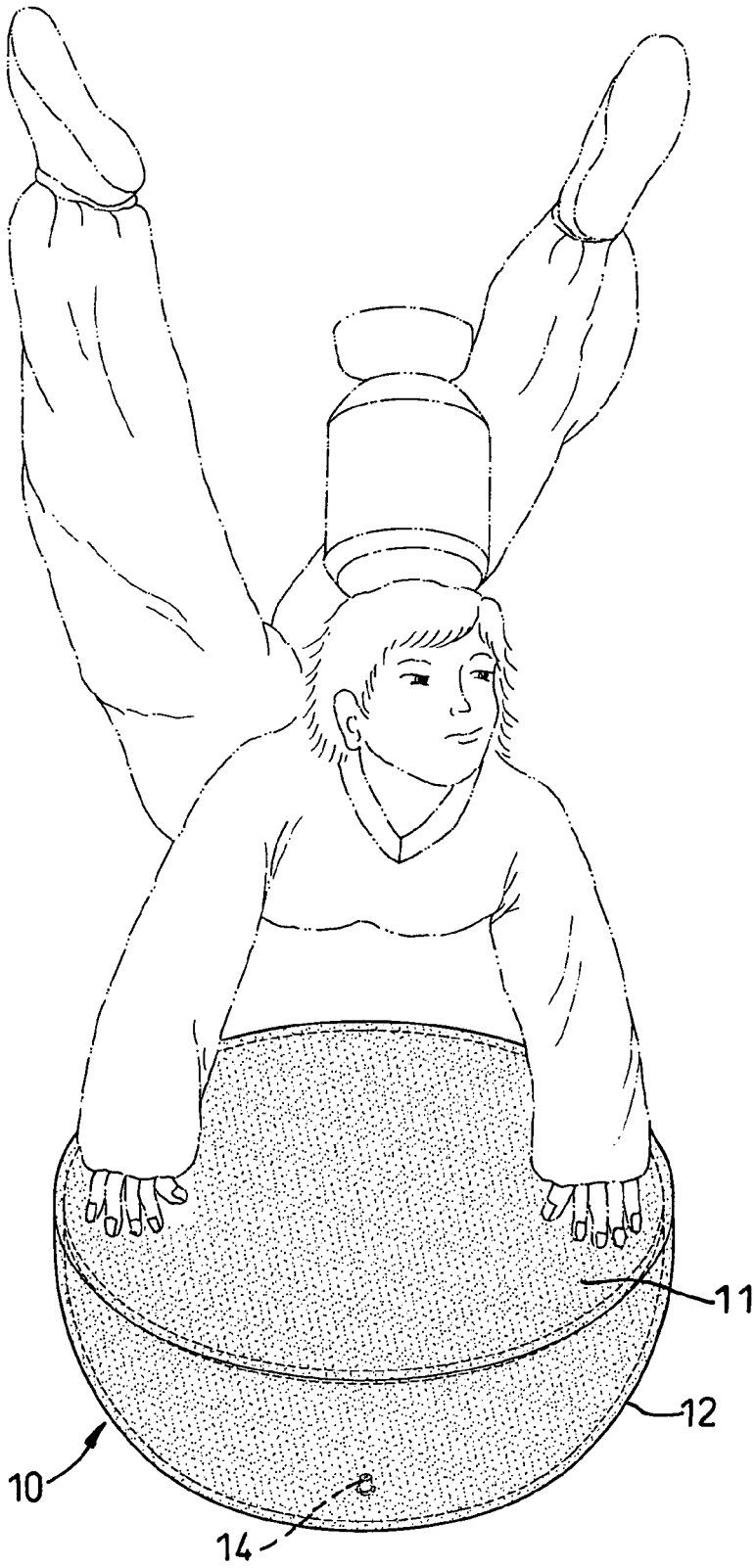
FIG. 5 is an another operational perspective view of the air cushion, wherein the air cushion is placed upside down for a user to develop balancing skills.

With reference to FIGS. 4 and 5, the foregoing air cushion need not be used with the bottom (11) of the bladder (10) abutting the ground. Because the bulge top is inherently less stable when inverted, the user will receive a more vigorous experience, which ma y be appropriate for athletic training.

Figure 6:
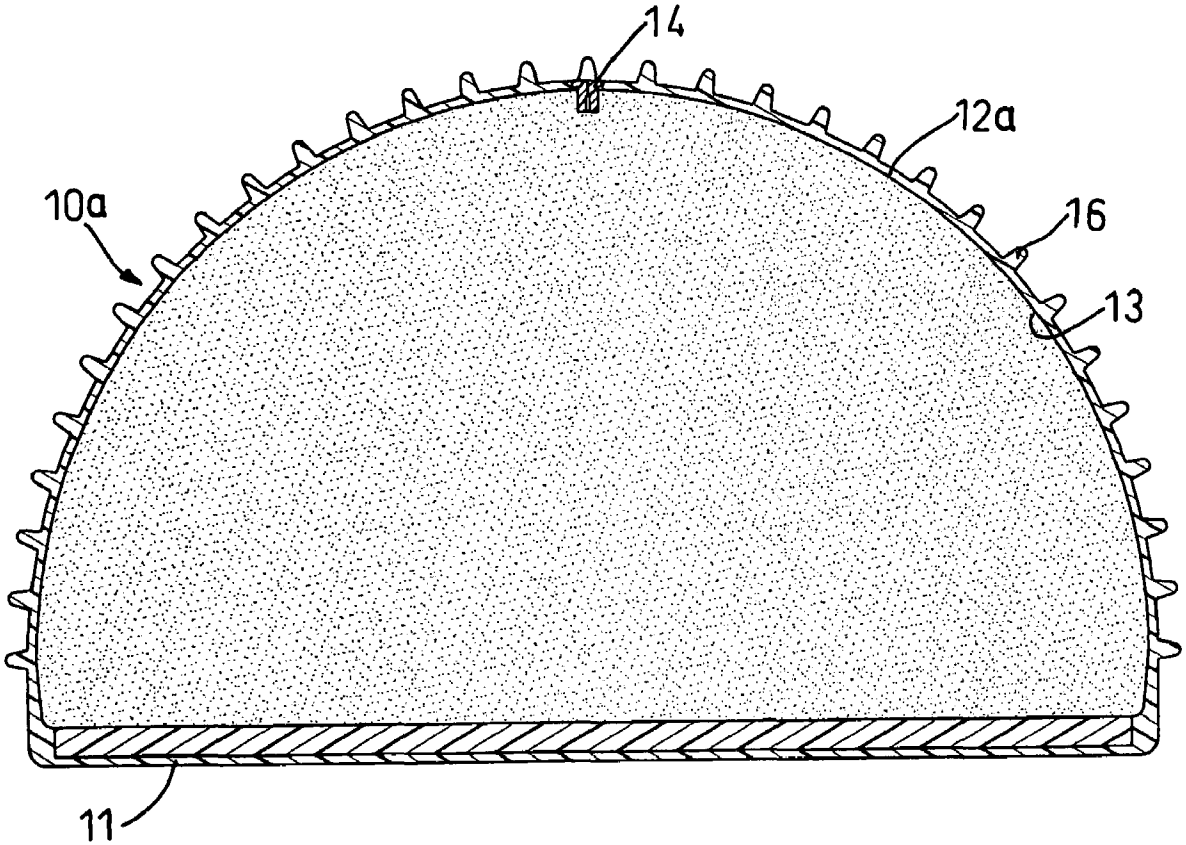
FIG. 6 is a cross-sectional side plane view of another embodiment of the air cushion for exercise, wherein the air cushion has multiple stubs formed on an outer periphery of a bladder.
Figure 7:
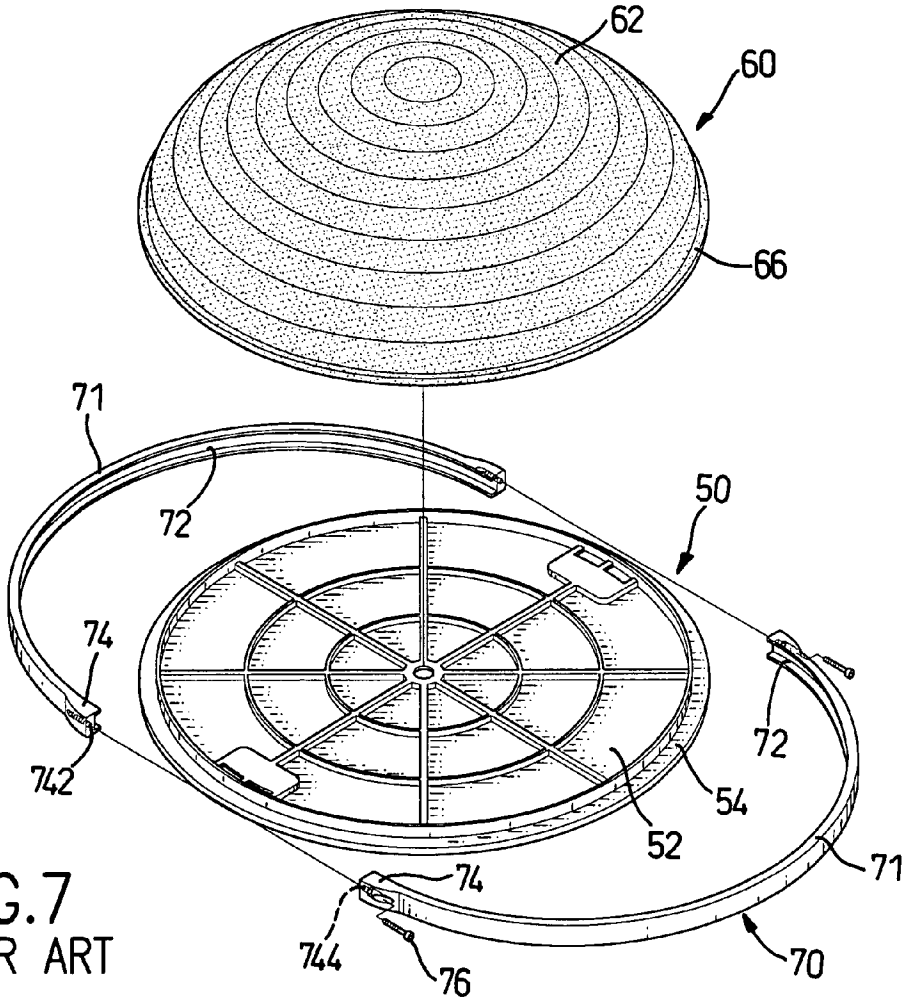
FIG. 7 PRIOR ART
FIG. 7 is an exploded perspective view of a conventional air cushion for exercise in accordance with the prior art.

With reference to FIG. 6, another embodiment of the air cushion for exercise further has multiple stubs (16). In the embodiment shown in FIG. 6, the stubs (16) are formed on the outer periphery of the bladder **(10*a*) at the bulge top (12*a*)** to stimulate acupuncture points at which a person is supposed to be activated to provide a massage efficiency when the user lies or stands on the bulge top of the air cushion.

Although the invention has been explained in relation to its preferred embodiment, many other possible modifications and variations can be made without departing from the spirit and scope of the invention as hereinafter claimed.

What is claimed is:

1. An air cushion for exercise comprising:

a bladder (10) made of resilient plastic material and having a bottom (11), a bulge top (12), an interior and an outer periphery; and a ballast stay (15) made of hard plastic material attached at the bottom (11) inside the bladder (10) to stiffen the bottom (11) and keep the bottom (11) flat, wherein said ballast stay is formed within said interior.

2. The air cushion for exercise as claimed in claim 1, wherein the bladder (10) further has multiple stubs formed on the outer periphery of the bladder (10).

3. The air cushion for exercise as claimed in claim 1, wherein the bulge top (12) has an apex and an air inlet formed on the apex of the bulge top (12) to permit air to be pumped into the bladder (10).

4. The air cushion for exercise as claimed in claim 2, wherein the bulge top (12) has an apex and an air inlet formed on the apex of the bulge top (12) to permit air to be pumped into the bladder (10).

5. The air cushion for exercise as claimed in claim 1, wherein the ballast stay (15) is formed with the bladder (10) in one piece.

6. The air cushion for exercise as claimed in claim 2, wherein the ballast stay (15) is formed with the bladder (10) in one piece.

7. The air cushion for exercise as claimed in claim 4, wherein the ballast stay (15) is formed with the bladder (10) in one piece.

8. The air cushion for exercise as claimed in claim 4, wherein the ballast stay (15) is formed with the bladder (10) as one substantially inseparable piece.

* * * * *